US011335521B2

(12) United States Patent
Imai

(10) Patent No.: US 11,335,521 B2
(45) Date of Patent: May 17, 2022

(54) INPUT APPARATUS

(71) Applicant: Alps Alpine Co., Ltd., Tokyo (JP)

(72) Inventor: Toshio Imai, Miyagi-ken (JP)

(73) Assignee: Alps Alpine Co., Ltd.

( * ) Notice: Subject to any disclaimer, the term of this patent is extended or adjusted under 35 U.S.C. 154(b) by 0 days.

(21) Appl. No.: 17/317,074

(22) Filed: May 11, 2021

(65) Prior Publication Data

US 2021/0265119 A1 Aug. 26, 2021

Related U.S. Application Data

(63) Continuation of application No. PCT/JP2019/044327, filed on Nov. 12, 2019.

(30) Foreign Application Priority Data

Dec. 28, 2018 (JP) ..... JP2018-248491

(51) Int. Cl.
*H01H 13/14* (2006.01)
*H01H 13/26* (2006.01)

(52) U.S. Cl.
CPC ..... *H01H 13/14* (2013.01); *H01H 13/26* (2013.01)

(58) Field of Classification Search
CPC ..... H01H 13/14; H01H 13/50; H01H 13/52; H01H 3/12; H01H 13/26; H01H 13/00; H01H 13/48; H01H 16/506; H01H 3/02
See application file for complete search history.

(56) References Cited

U.S. PATENT DOCUMENTS

2011/0011715 A1* 1/2011 Itou ..... H01H 13/705 200/517
2015/0228423 A1* 8/2015 Sanford ..... H01H 13/14 200/341
2017/0148586 A1* 5/2017 Lee ..... H01H 13/14

FOREIGN PATENT DOCUMENTS

JP S59-093035 U 6/1984
JP 2012-195072 A 10/2012
JP 2012-243406 A 12/2012

OTHER PUBLICATIONS

International Search Report for International Application No. PCT/JP2019/044327 dated Dec. 24, 2019 (2 pages).

* cited by examiner

*Primary Examiner* — Lheiren Mae A Caroc
(74) *Attorney, Agent, or Firm* — Harness, Dickey & Pierce, P.L.C.

(57) ABSTRACT

An input apparatus includes a base member, an operating member provided so as to be vertically movable with respect to the base member, the operating member being to be pushed down, a circuit board fixed to the base member and provided under the operating member, a push switch provided on a lower surface of the circuit board, and a link mechanism including a rotational member disposed under the circuit board such that a rotation center shaft is rotatably held by the base member, the rotational member pushing the push switch upward by rotating in response to a push-down operation of the operating member.

6 Claims, 11 Drawing Sheets

INPUT APPARATUS

CLAIM OF PRIORITY

This application is a Continuation of International Application No. PCT/JP2019/044327 filed on Nov. 12, 2019, which claims benefit of Japanese Patent Application No. 2018-248491 filed on Dec. 28, 2018. The entire contents of each application noted above are hereby incorporated by reference.

BACKGROUND OF THE INVENTION

1. Field of the Invention

The present invention relates to an input apparatus.

2. Description of the Related Art

For example, Japanese Unexamined Patent Application Publication No. 2007-173015 discloses a technique for a push switch including a movable contact to transmit the pushing force of a push button to the push switch via a rotatable member. This technique allows the push switch to be operated with substantially the same operation load and gives similar click feeling no matter where the push button is pressed.

However, the technique disclosed in Japanese Unexamined Patent Application Publication No. 2007-173015 needs to provide the rotatable member between a circuit board on which the push switch is mounted and an operating member, which makes it impossible to make effective use of the space between the circuit board and the operating member.

SUMMARY OF THE INVENTION

The present invention provides an input apparatus including a base member, an operating member provided so as to be vertically movable with respect to the base member, the operating member being to be pushed down, a circuit board fixed to the base member and provided under the operating member, a push switch provided on a lower surface of the circuit board, and a link mechanism including a rotational member disposed under the circuit board such that a rotation center shaft is rotatably held by the base member, the rotational member pushing the push switch upward by rotating in response to a push-down operation of the operating member.

In an input apparatus in which a push switch is pushed down by a push-down operation on an operating member according to an embodiment, the space between a circuit board on which the push switch is mounted and the operating member can be used effectively.

DESCRIPTION OF THE PREFERRED EMBODIMENTS

Figure 1:
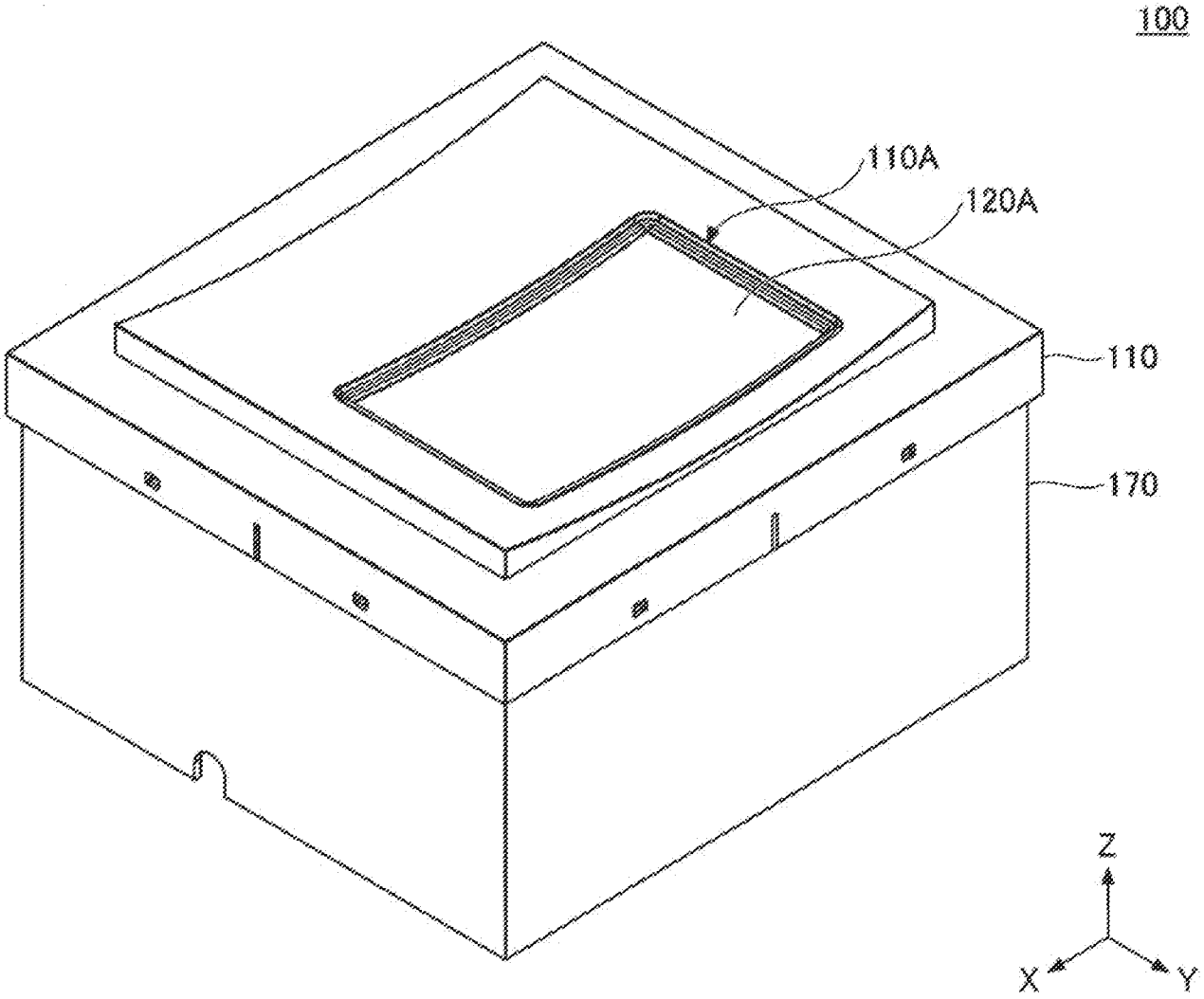
FIG. 1 is an external perspective view of an input apparatus according to an embodiment.

Referring to the drawings, an embodiment will be described hereinbelow. In the following description, the Z-axis positive direction in the drawings is above, and the Z-axis negative direction in the drawings is below by way of example. However, the dispositions, the operating directions, and so on of the components are not limited thereto. In other words, the relative positional relationship, relative operating directions, and so on of the disposed components may be, not the Z-axis direction in the drawings, but the X-axis or Y-axis direction or any direction in the drawings that satisfy the purport of the present invention.

Brief Overview of Input Apparatus 100

FIG. 1 is an external perspective view of an input apparatus 100 according to an embodiment. The input apparatus 100 shown in FIG. 1 is an apparatus for use as a switch for controlling the operation of an electrical component of a vehicle, such as an automobile. However, this is given for mere illustrative purposes. The input apparatus 100 can be used for various applications, such as home electronics and personal digital assistants.

As shown in FIG. 1, the input apparatus 100 has a substantially rectangular parallelepiped outer shape in which a case 170 and a cover member 110 are combined to each other. The case 170 and the cover member 110 are examples of "base member". In the present embodiment, "base member" is constituted by two components, but this is given for mere illustrative purposes. The "base member" may be formed as a single unit or a combination of three or more components. The input apparatus 100 has an opening 110A, which is rectangular in plan view seen from above, in the upper surface of the cover member 110. An operating portion 120A of an operating member 120 is exposed from the opening 110A. This allows the user to push down the operating portion 120A of the input apparatus 100.

When the operating portion 120A is pushed down by the user, a push switch 152 (FIG. 8) provided in the case 170 of the input apparatus 100 is pressed into an ON state, and a control signal indicating the ON state is output to an external device to be controlled by the input apparatus 100 via various kinds of electrical component (not illustrated, for example, an electric cable or a connector).

The input apparatus 100 includes an electrostatic sensor 130 (see FIG. 2) below the operating portion 120A. Thus, when the operating portion 120A is pushed down by the user, the contact position is detected by the electrostatic sensor 130, and a control signal indicating the contact position is output to an external device to be controlled by the input apparatus 100 via various kinds of electrical component (for example, an electric cable or a connector).

The operating portion 120A of the input apparatus 100 has a relatively wide operating surface. However, no matter where of the operating surface is pressed, similar operation feeling can be given by a link mechanism 160 (see FIG. 2) provided in the case 170. For example, the input apparatus 100 includes the push switch 152 that gives click operation feeling under the center of the operating portion 120A, but gives similar click operation feeling in the case where the center of the operating portion 120A is pressed and the case where an end of the operating portion 120A is pressed.

Configuration of Input Apparatus 100

Figure 2:
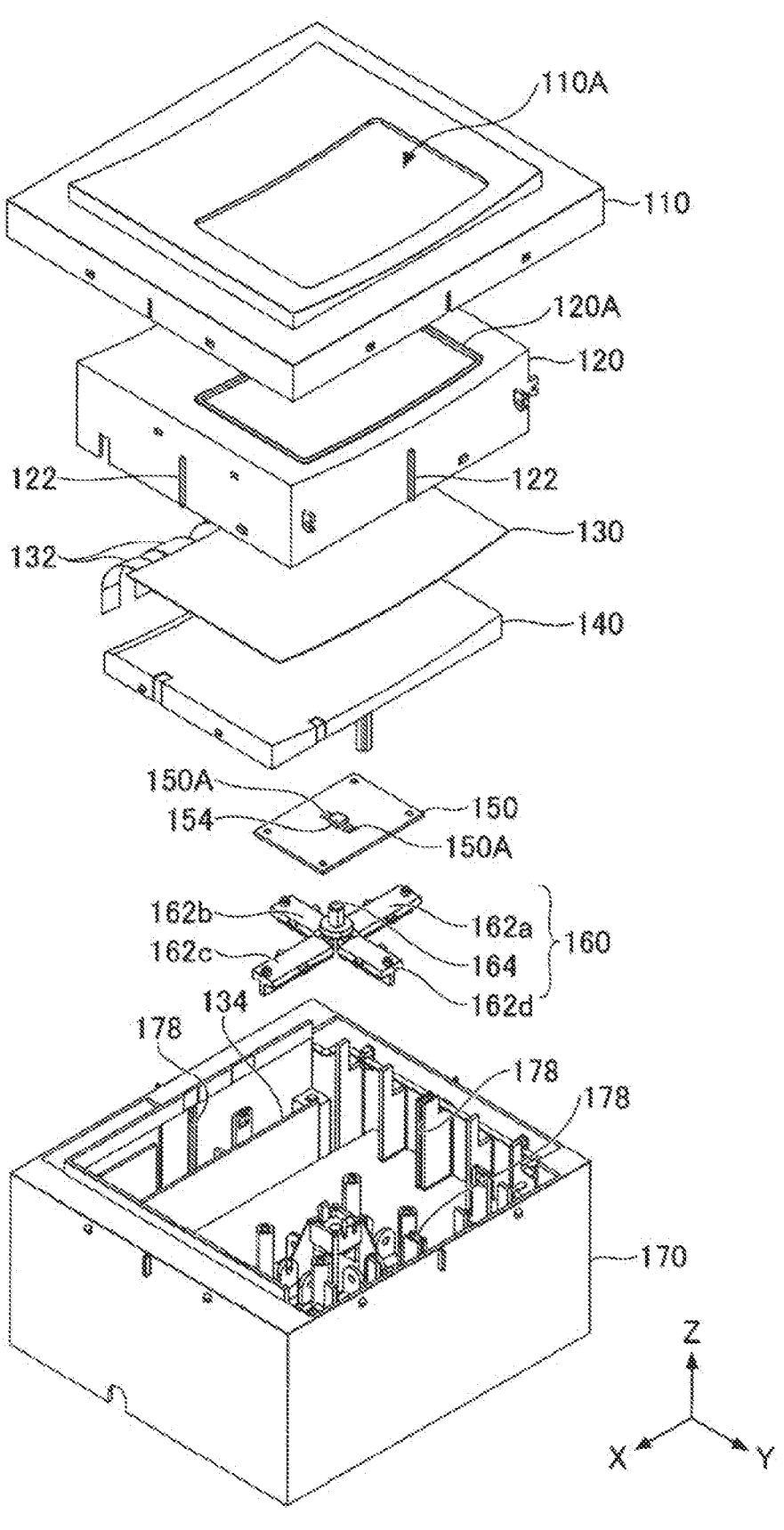
FIG. 2 is an exploded perspective view of the input apparatus according to an embodiment.

FIG. 2 is an exploded perspective view of the input apparatus 100 according to an embodiment. As shown in FIG. 2, the input apparatus 100 includes the cover member 110, the operating member 120, the electrostatic sensor 130, a pushing member 140, a circuit board 150, the link mechanism 160, and the case 170 from above in the drawing.

The cover member 110 is a cover-like member attached to the top of the case 170 to close the upper opening of the case 170. The cover member 110 has the opening 110A, in the upper surface, which is rectangular in plan view seen from above. The opening 110A is provided to expose the operating portion 120A of the operating member 120 provided under the cover member 110 to allow the user to push down the operating portion 120A.

The operating member 120 is a member that is provided, in the case 170, under the cover member 110 so as to be movable in the vertical direction (in the Z-axis direction in the drawing) and that is to be pressed by the user. The operating member 120 has the form of a substantially rectangular parallelepiped of which the bottom is open. The upper surface of the operating member 120 is provided with the operating portion 120A that is rectangular in plan view seen from above. The operating portion 120A is a portion exposed from the opening 110A of the cover member 110 and to be pressed by the user. Inside the operating member 120 (in other words, under the operating portion 120A), the electrostatic sensor 130 and the pushing member 140 are installed through the opening at the bottom.

The electrostatic sensor 130 is a film-like member underlies the operating portion 120A in the operating member 120. The electrostatic sensor 130 includes a plurality of sensing electrodes (not shown) and detects the contact position at the operating surface of the operating portion 120A on the basis of changes in the electrostatic capacitances of the plurality of sensing electrodes. The electrostatic sensor 130 is connected to a controller 134 provided in the case 170 by a flexible printed circuit (FPC) 132. This allows the electrostatic sensor 130 to drive the plurality of sensing electrodes from the controller 134.

The pushing member 140 is a plate-like member underlying the electrostatic sensor 130 in the operating member 120 (in other words, under the operating portion 120A). When the operating member 120 is pressed, the pushing member 140 moves downward together with the operating member 120. This causes the pushing member 140 to push one end of each of four rotational members 162*a*, 162*b*, 162*c*, and 162*d* of the link mechanism 160 with four pushing portions 142*a*, 142*b*, 142*c*, and 142*d* (see FIGS. 3 and 4) provided at the lower surface of the pushing member 140, respectively. The four pushing portions and the four rotational members of the present embodiment are examples of "a plurality of pushing portions" and "a plurality of rotational members", respectively.

The circuit board 150 is a relatively hard plate-like member made of glass epoxy or the like. The circuit board 150 is disposed horizontally (in other words, parallel to an X-Y plane) in the case 170 and is screwed to the case 170 at four corners. An example of the circuit board 150 is a printed wiring board (PWB). The push switch 152 is mounted downward on the lower surface of the circuit board 150. The push switch 152 is a so-called metal dome switch. When the operating surface of the push switch 152 is pushed, the top of a metal-dome-like movable contact member (not shown) disposed inside is reversed to switch the push switch 152 to the ON state. At that time, the reversing action of the movable contact member causes click feeling at the operating surface of the push switch 152. The push switch 152 is electrically connected the external device to be operated by the input apparatus 100 via various kinds of electrical component (for example an electric cable or a connector) (not shown). A light-emitting diode (LED) 154 may be mounted on the upper surface of the circuit board 150. The LED 154 is an example of "light-emitting means", which emits light toward the operating member 120.

The link mechanism 160 may include the rotational members 162*a*, 162*b*, 162*c*, and 162*d* and a lifting member 164. The rotational members 162 are each retained to four pairs of supports 174*a*, 174*b*, 174*c*, and 174*d* provided in the case 170 so as to be integrated with the case 170 such that the rotation center shafts 162A, 162B, 162C, and 162D rotate freely. Each rotational member 162 is rotated by one end (an end farthest from a pushing center point P, hereinafter referred to as "outer end") being pushed down by a pushing portion 142 of the four pushing portions 142 of the pushing member 140 closest to the point of push-down operation, and the other end (an end closest to the pushing center point P, hereinafter referred to as "inner end") is pushed up. The other end of each rotational member 162 is in contact with a lower end face 164*b* (see FIGS. 8 and 9) of the lifting member 164 in its initial state. This allows each rotational member 162 to push up the lifting member 164 with the other end since one end is pushed down.

The lifting member 164 is a columnar member extending in the vertical direction, which is disposed facing the lower side of the push switch 152. An upper end face 164*a* (see FIGS. 8 and 9) of the lifting member 164 is in contact with the operating surface of the push switch 152. The upper end face 164*a* need only have a size large enough to push the operating surface of the push switch 152. In the present embodiment, the upper end face 164*a* has substantially the same radius as that of the operating surface of the push switch 152. The lower end face 164*b* of the lifting member 164 is larger than the upper end face 164*a* in the radial direction and has a radius large enough to contact all of protrusions 162*a*2, 162*b*2, 162*c*2, and 162*d*2 at the inner ends of the upper surfaces of the plurality of rotational members 162. Part of the upper end face 164*a* of the lifting member 164 may pass through a through-hole 172A of a retaining member 172 so as to be vertically slidable in the through-hole 172A. Thus, the vertical movement of the rotational member 162 is guided by the through-hole 172A. In other words, when the lifting member 164 is pushed up by the rotational member 162, the lifting member 164 can move upward in the upright posture, thereby pressing the operating surface of the push switch 152 assuredly.

The case 170 is a substantially rectangular parallelepiped container-shaped member with an open top. The upper opening of the case 170 is closed by the cover member 110, with the components (the electrostatic sensor 130, the pushing member 140, the circuit board 150, and the link mechanism 160) installed therein.

Configuration of Pushing Member 140

Figure 3:
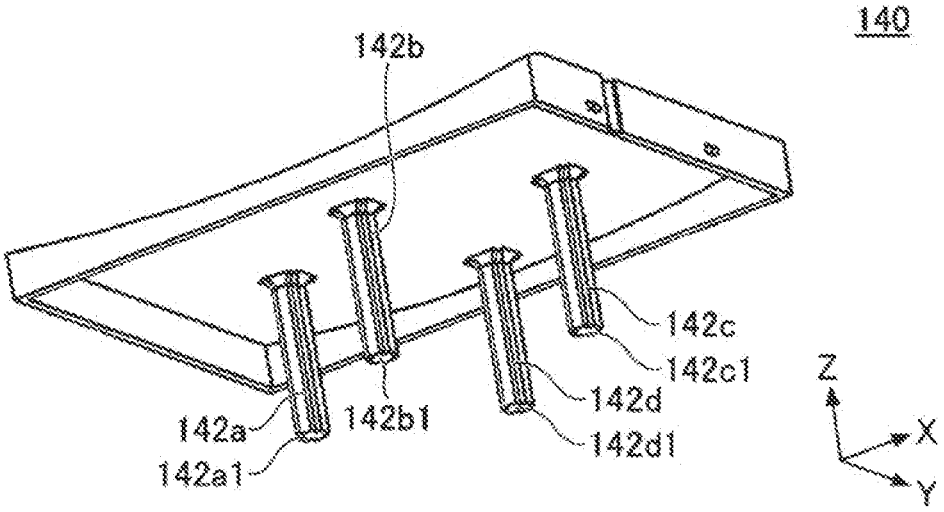
FIG. 3 is an external perspective view of a pushing member of the input apparatus according to an embodiment illustrating the configuration on the lower surface side.
Figure 4:
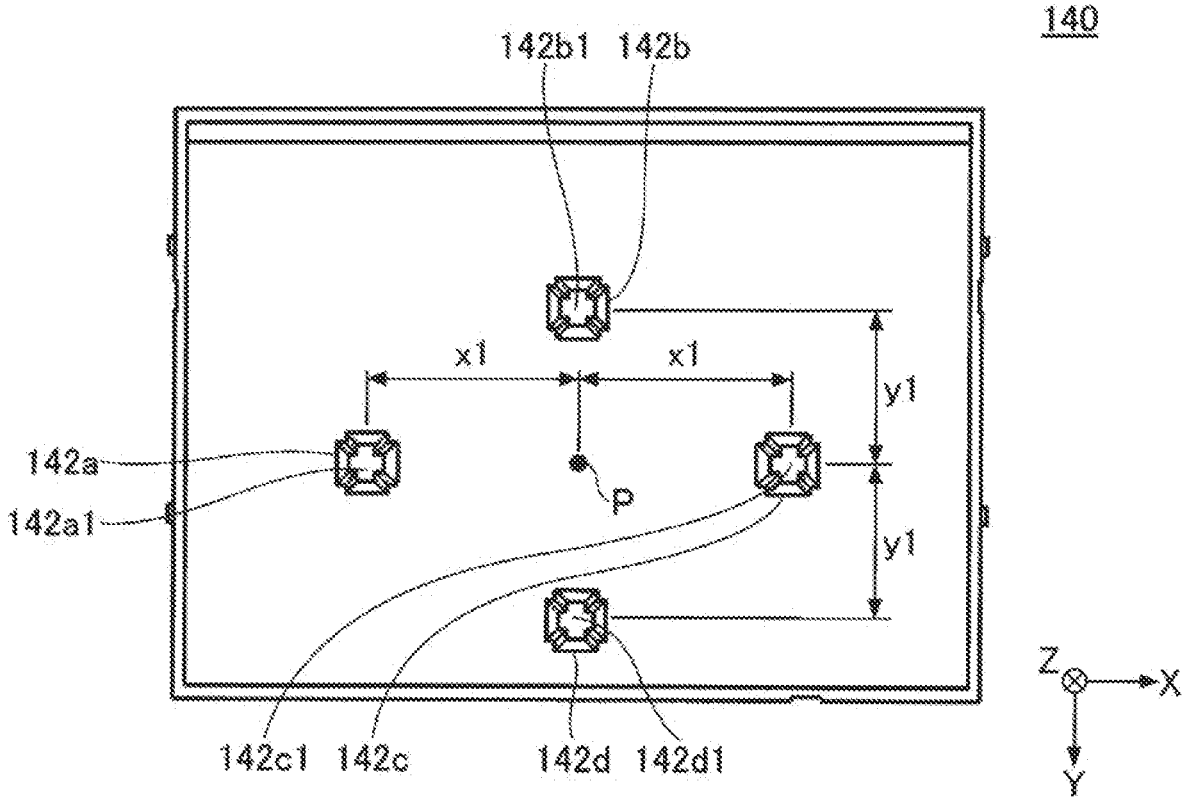
FIG. 4 is a bottom view of the pushing member of the input apparatus according to an embodiment.

FIG. 3 is an external perspective view of the pushing member 140 of the input apparatus 100 according to an embodiment illustrating the configuration on the lower surface side. FIG. 4 is a bottom view of the pushing member 140 of the input apparatus 100 according to an embodiment. As shown in FIGS. 3 and 4, the four columnar pushing portions 142*a*, 142*b*, 142*c*, and 142*d* extending downward are provided at the lower surface of the pushing member 140.

The pushing portion 142*a* is disposed a predetermined distance x1 away in the X-axis negative direction from the pushing center point P of the push switch 152. The pushing portion 142*a* extends to below the circuit board 150, and a lower end face 142*a*1 comes into contact with and pushes down a protrusion 162*a*1 at the outer end of the upper surface of the rotational member 162*a*.

The pushing portion 142*b* is disposed a predetermined distance y1 away in the Y-axis negative direction from the pushing center point P of the push switch 152. The pushing portion 142*b* extends to below the circuit board 150, and a lower end face 142*b*1 comes into contact with and pushes down a protrusion 162*b*1 at the outer end of the upper surface of the rotational member 162*b*.

The pushing portion 142*c* is disposed a predetermined distance x1 away in the X-axis positive direction from the pushing center point P of the push switch 152. The pushing portion 142*c* extends to below the circuit board 150, and a lower end face 142*c*1 comes into contact with and pushes down a protrusion 162*c*1 at the outer end of the upper surface of the rotational member 162*c*.

The pushing portion 142*d* is disposed a predetermined distance y1 away in the Y-axis positive direction from the pushing center point P of the push switch 152. The pushing portion 142*d* extends to below the circuit board 150, and a lower end face 142*d*1 comes into contact with and pushes down a protrusion 162*d*1 on the outer end of the upper surface of the rotational member 162*d*.

Configuration of Link Mechanism 160

Figure 5:
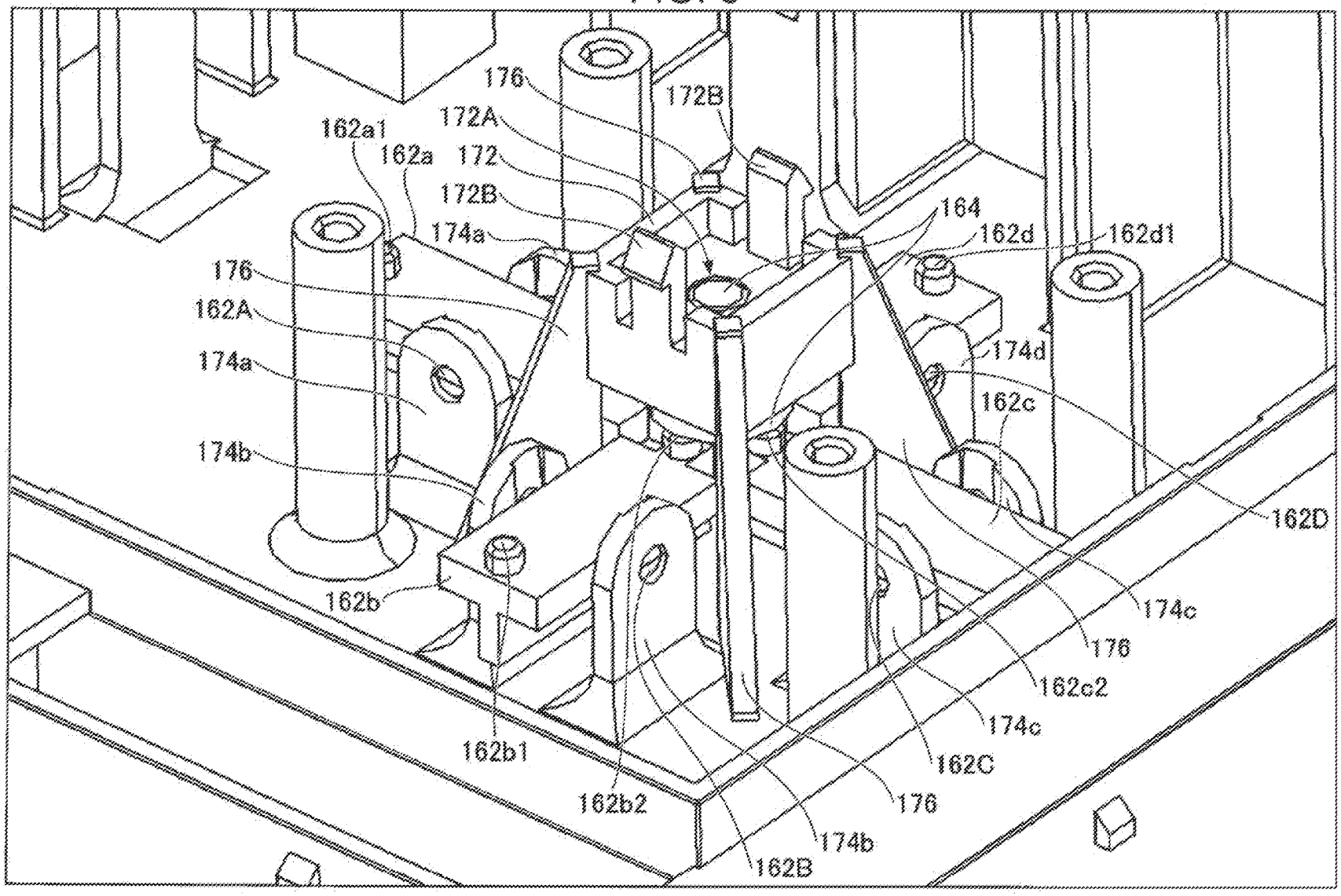
FIG. 5 is a partial enlarged diagram illustrating the configuration of a link mechanism of the input apparatus according to an embodiment.
Figure 6:
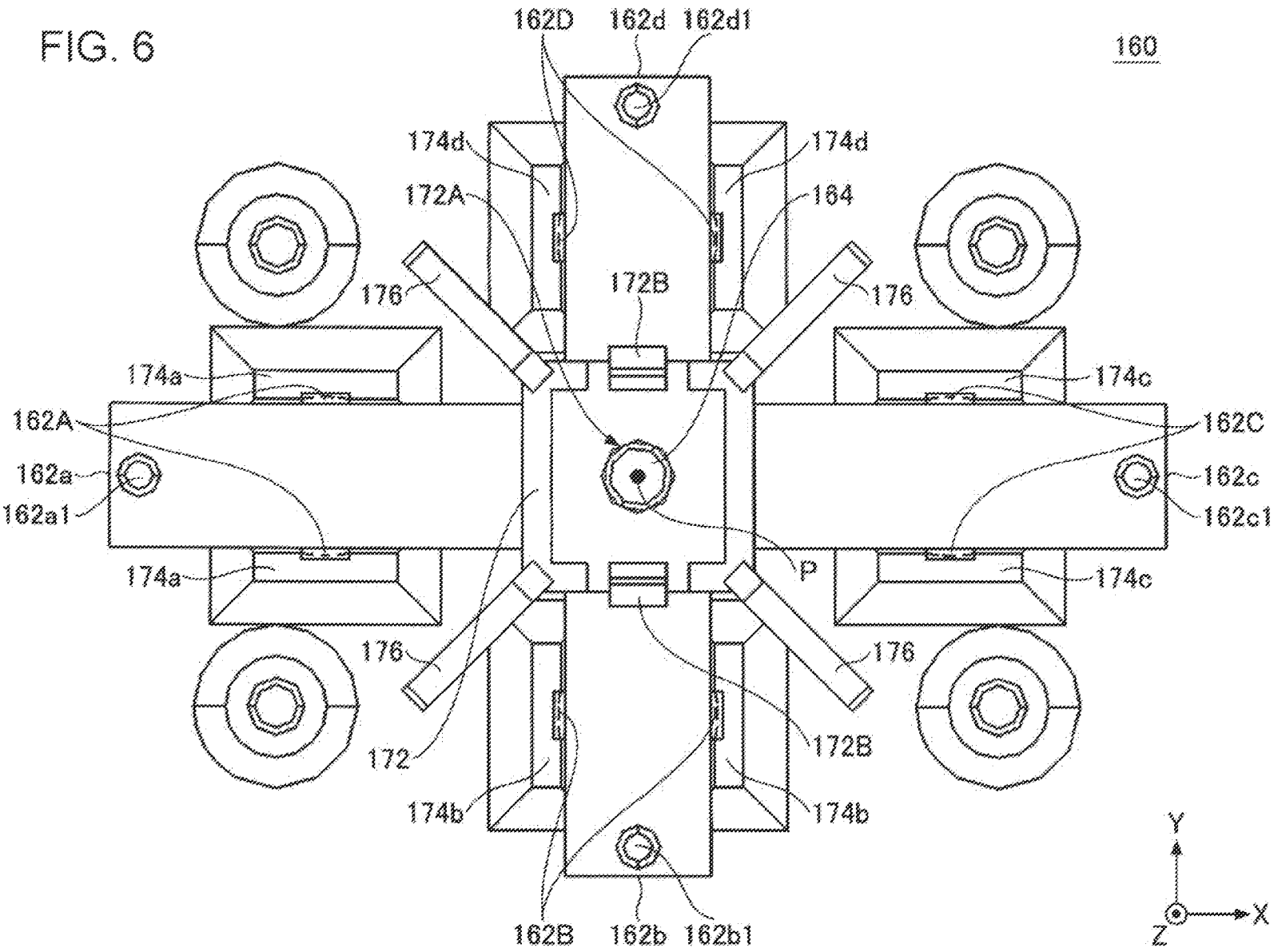
FIG. 6 is a plan view of the link mechanism of the input apparatus according to an embodiment, illustrating the configuration thereof.

FIG. 5 is a partial enlarged diagram illustrating the configuration of the link mechanism 160 of the input apparatus 100 according to an embodiment. FIG. 6 is a plan view of the link mechanism 160 of the input apparatus 100 according to an embodiment, illustrating the configuration thereof.

As shown in FIGS. 5 and 6, the link mechanism 160 includes the lifting member 164 disposed at a position facing the push switch 152 (in other words, the pushing center point P) and the four rotational members 162*a*, 162*b*, 162*c*, and 162*d* extending in different directions from one another from below the lifting member 164 and disposed in the form of a cross in plan view seen from above.

The rotational member 162*a* extends from below the lifting member 164 in the X-axis negative direction. The rotational member 162*a* is rotatable in the vertical direction since the rotation center shaft 162A is supported by a pair of supports 174*a* vertically erected from the bottom of the case 170.

The rotational member 162*b* extends from below the lifting member 164 in the Y-axis negative direction. The rotational member 162*b* is rotatable in the vertical direction since the rotation center shaft 162B is supported by a pair of supports 174*b* vertically erected from the bottom of the case 170.

The rotational member 162*c* extends from below the lifting member 164 in the X-axis positive direction. The rotational member 162*c* is rotatable in the vertical direction since the rotation center shaft 162C is supported by a pair of supports 174*c* vertically erected from the bottom of the case 170.

The rotational member 162*d* extends in the Y-axis positive direction from below the lifting member 164. The rotational member 162*d* is rotatable in the vertical direction since the rotation center shaft 162D is supported by a pair of supports 174*d* vertically erected from the bottom of the case 170.

The protrusions 162*a*2, 162*b*2, 162*c*2, and 162*d*2 at the respective inner ends of the rotational members 162*a*, 162*b*, 162*c*, and 162*d* are in contact with the lower end face 164*b* of the lifting member 164. This allows the rotational members 162*a*, 162*b*, 162*c*, and 162*d* to push up the lifting member 164 with the protrusions 162*a*2, 162*b*2, 162*c*2, and 162*d*2 at the inner ends when the protrusions 162*a*1, 162*b*1, 162*c*1, and 162*d*1 at the outer ends are pushed down.

At the position facing the operating surface of the push switch 152 in plan view (in other words, the pushing center point P), the retaining member 172 is provided in addition to the lifting member 164. The retaining member 172 has the shape of a substantially rectangular parallelepiped, which is supported at the corners by four support walls 176 erected from the bottom of the case 170. The retaining member 172 may include a pair of hooks 172B (an example of "retaining arms") extending upward. The pair of hooks 172B passes through a pair of openings 150A (see FIG. 9) formed at adjacent positions of the circuit board 150, with the push switch 152 therebetween, and engages with the upper surface of the circuit board 150 to retain the circuit board 150 from below. The retaining member 172 has, at the center, a through-hole 172A passing through the retaining member 172 in the vertical direction. The through-hole 172A is provided so that the lifting member 164 is movable in the vertical direction.

Configuration for Pushing Down Rotational Member 162

Figure 7:
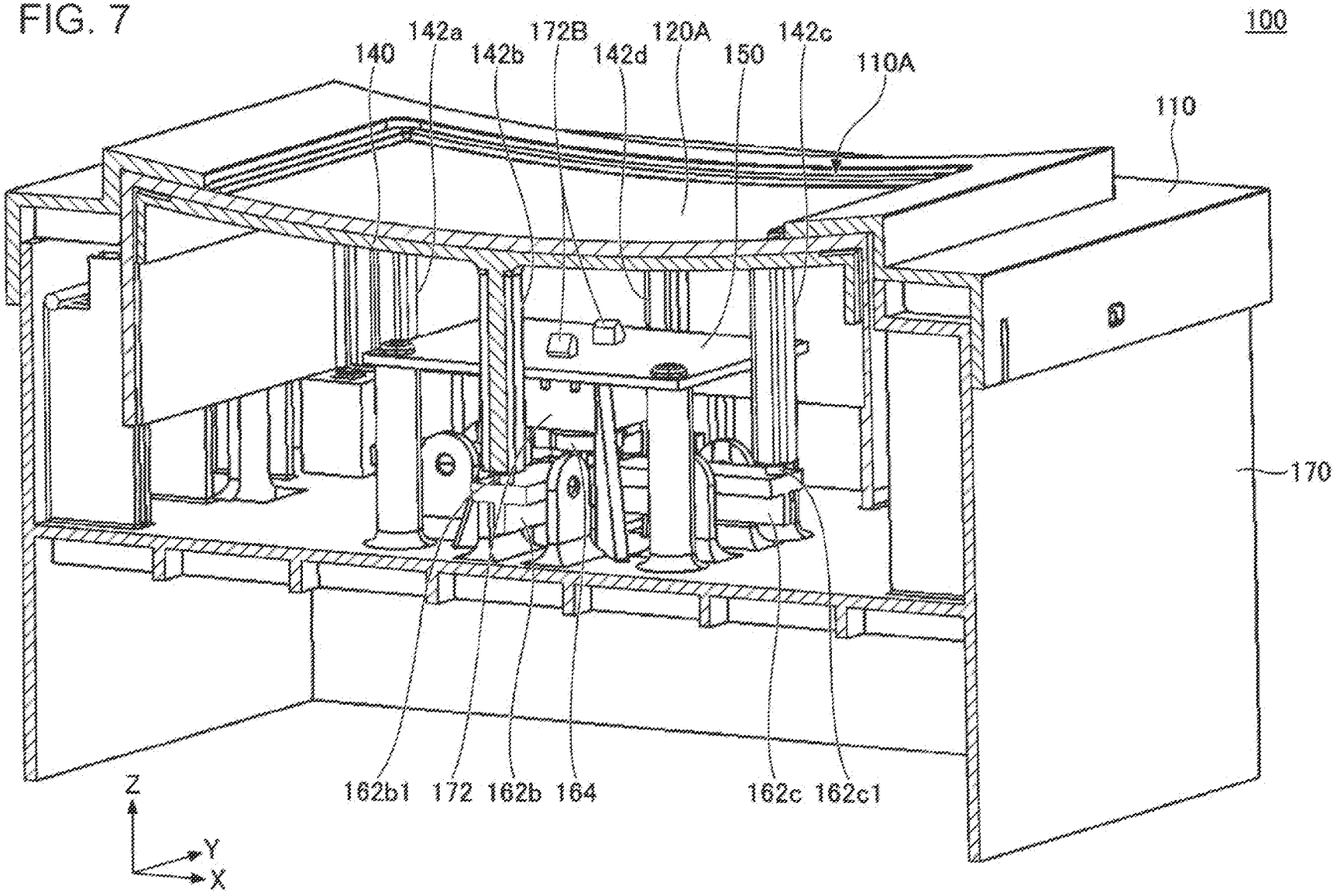
FIG. 7 is a perspective cross-sectional view of the input apparatus according to an embodiment taken along an X-Z plane.
Figure 8:
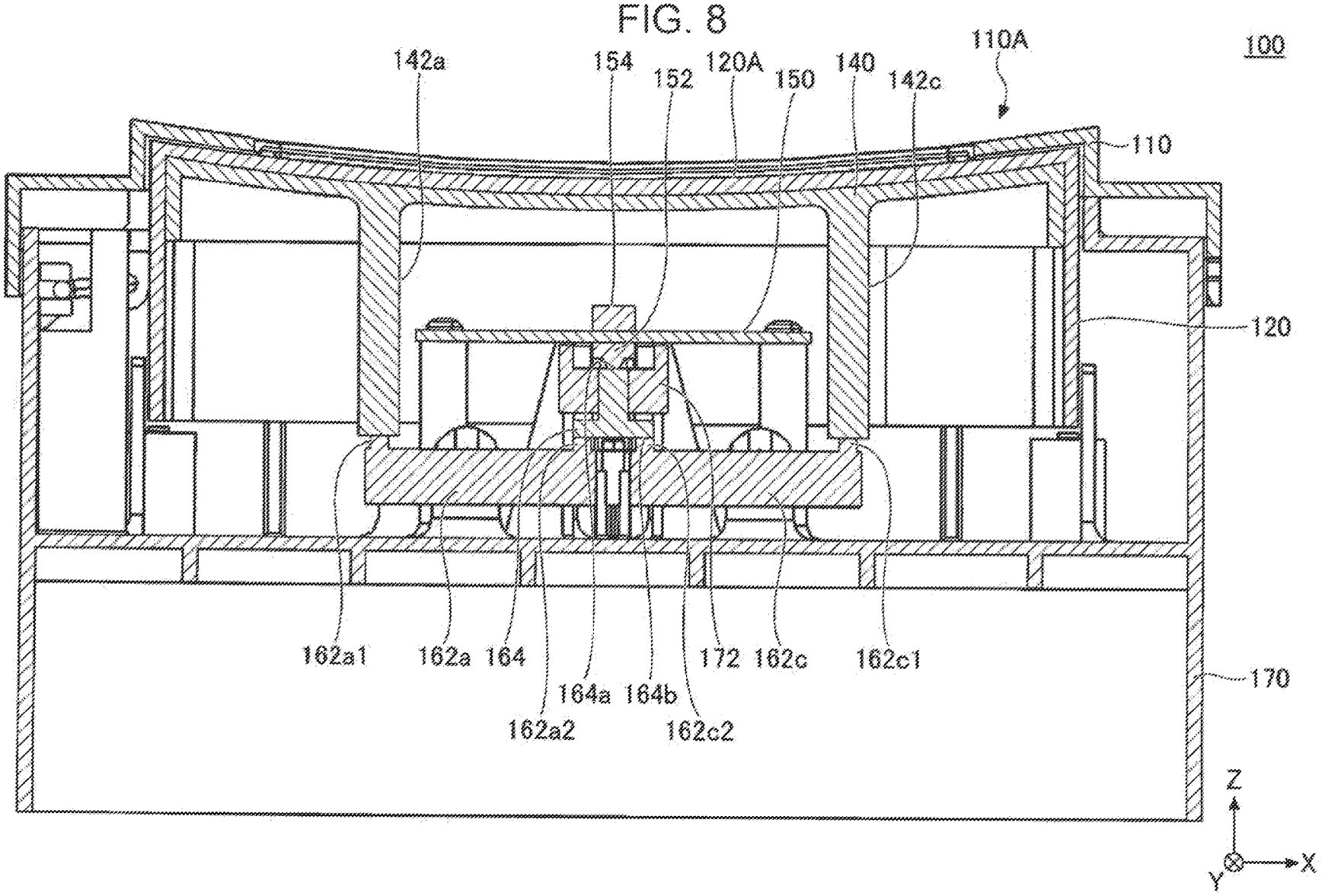
FIG. 8 is a cross-sectional view of the input apparatus according to an embodiment taken along an X-Z plane.
Figure 9:
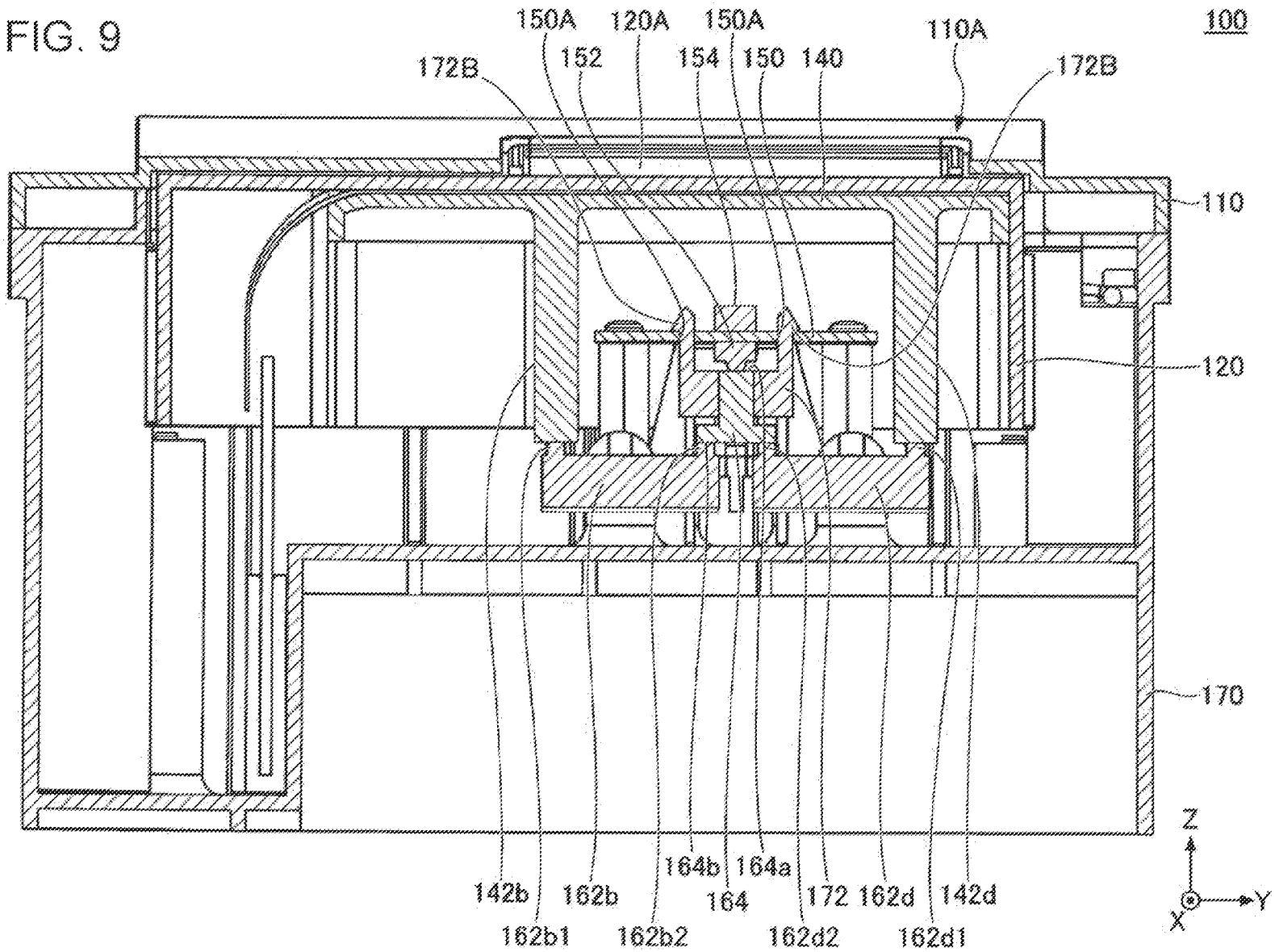
FIG. 9 is a cross-sectional view of the input apparatus according to an embodiment taken along a Y-Z plane.

FIG. 7 is a perspective cross-sectional view of the input apparatus 100 according to an embodiment taken along an X-Z plane. FIG. 8 is a cross-sectional view of the input apparatus 100 according to an embodiment taken along an X-Z plane. FIG. 9 is a cross-sectional view of the input apparatus 100 according to an embodiment taken along a Y-Z plane.

As shown in FIGS. 7 to 9, the four columnar pushing portions 142*a*, 142*b*, 142*c*, and 142*d* extending downward are provided at the lower surface of the pushing member 140.

The lower end face 142*a*1 of the pushing portion 142*a* is in contact with the protrusion 162*a*1 formed on the upper surface at the outer end of the rotational member 162*a*. This allows the pushing portion 142*a* to push down the outer end of the rotational member 162*a* when the pushing member 140 is pushed down with the operating member 120.

The lower end face 142*b*1 of the pushing portion 142*b* is in contact with the protrusion 162*b*1 formed on the upper surface at the outer end of the rotational member 162*b*. This allows the pushing portion 142*b* to push down the outer end of the rotational member 162*b* when the pushing member 140 is pushed down with the operating member 120.

The lower end face 142*c*1 of the pushing portion 142*c* is in contact with the protrusion 162*c*1 formed on the upper surface at the outer end of the rotational member 162*c*. This allows the pushing portion 142*c* to push down the outer end of the rotational member 162*c* when the pushing member 140 is pushed down with the operating member 120.

The lower end face 142*d*1 of the pushing portion 142*d* is in contact with the protrusion 162*d*1 formed on the upper surface at the outer end of the rotational member 162*d*. This allows the pushing portion 142*d* to push down the outer end of the rotational member 162*d* when the pushing member 140 is pushed down with the operating member 120.

Operation of Input Apparatus 100

Figure 10:
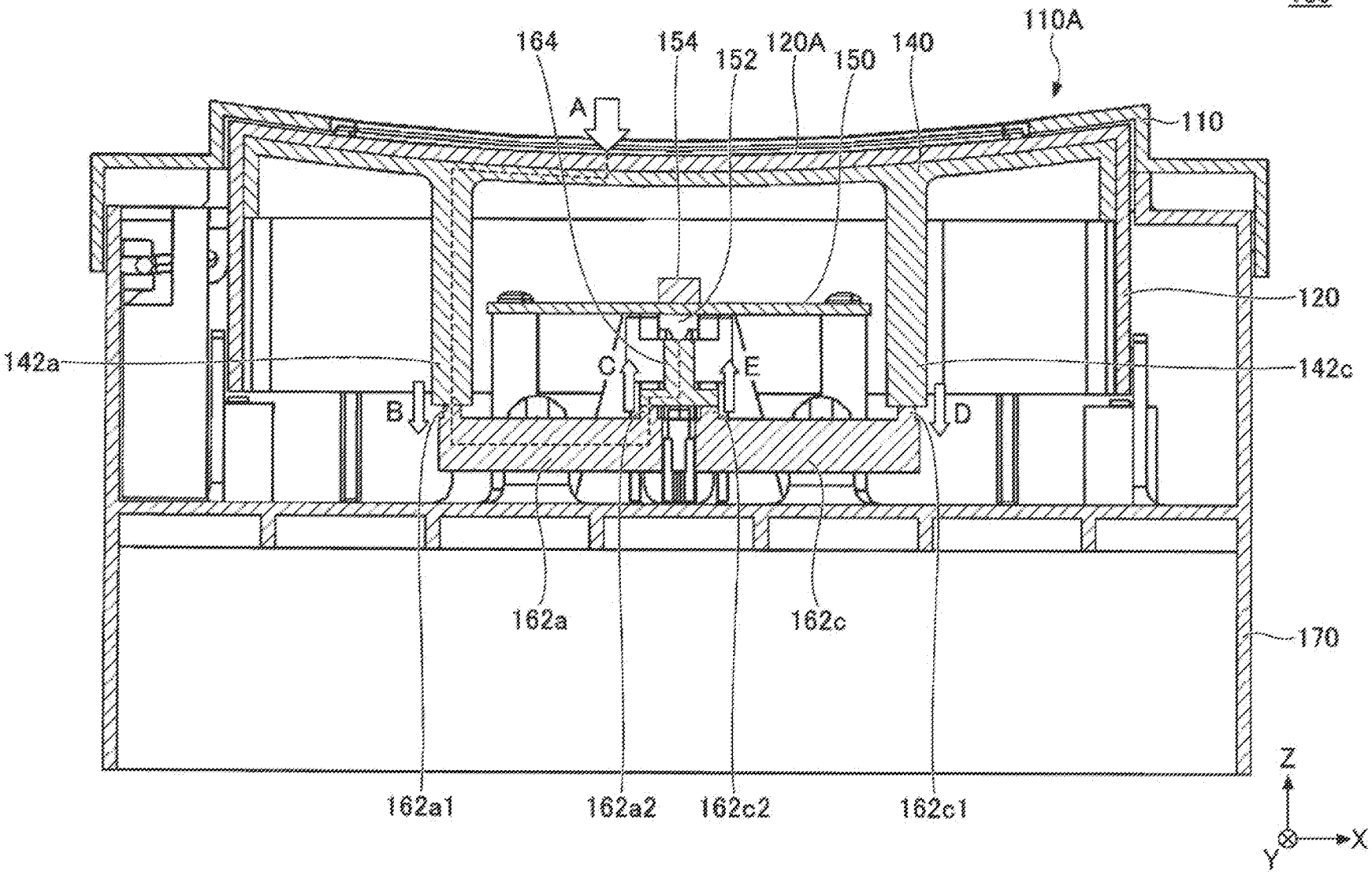
FIG. 10 is a cross-sectional view of the input apparatus according to an embodiment taken along an X-Z plane for illustrating the operation thereof.
Figure 11:
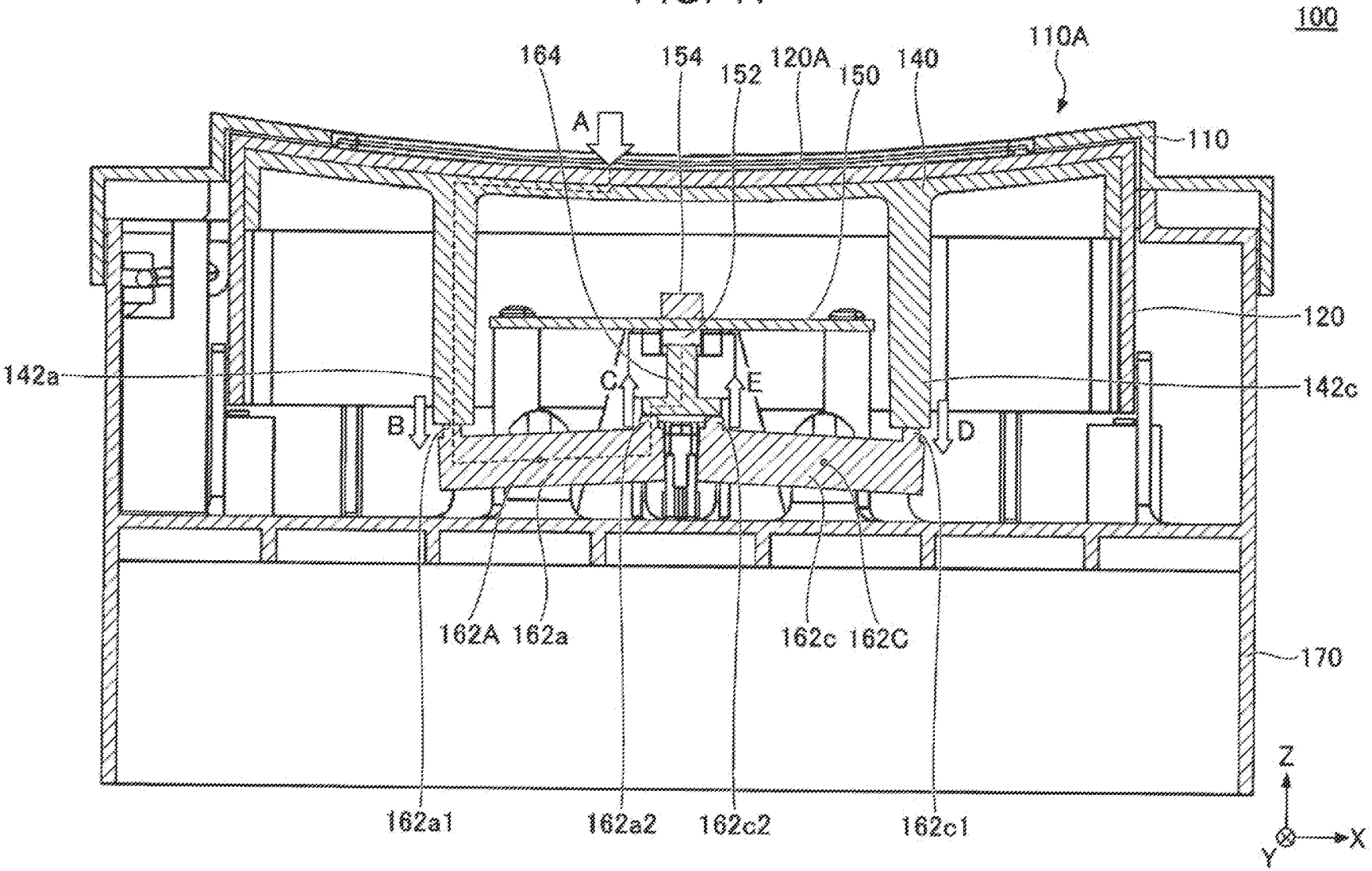
FIG. 11 is a cross-sectional view of the input apparatus according to an embodiment taken along an X-Z plane for illustrating the operation thereof.

FIGS. 10 and 11 are cross-sectional views of the input apparatus 100 according to an embodiment taken along an X-Z plane for illustrating the operation thereof. FIG. 10 illustrates the state of the input apparatus 100 before a push-down operation (in other words, a switch-OFF state). FIG. 11 illustrates the state of the input apparatus 100 after the push-down operation (in other words, a switch ON state). This is an example of a push-down operation not at the center of the operating portion 120A of the operating member 120 but at an offset point at which the pushing portion 142*a* is the closest position.

When the operating portion 120A of the operating member 120 is first pushed (arrow A in the drawing) through the opening 110A of the cover member 110, the pushing member 140 is pushed down with the operating member 120. The operating member 120 has a guide rib 122 (see FIG. 2) extending in the vertical direction at each of the four sides. Each guide rib 122 is movable in the vertical direction and is prevented from moving in the lateral direction by a guide groove 178 (see FIG. 2) formed in the case 170. This allows the operating member 120 and the pushing member 140 to move to a lower predetermined position in plan view even if a point of the operating portion 120A other than the center is pushed down. However, the pushing member 140 can also move downward in the state where it is slightly inclined to the pushed point from the center because there is a minute gap between each guide rib 122 and each guide groove 178.

Since the pushing member 140 is pushed down in the slightly inclined state, the pushing portion 142*a* of the four pushing portions 142*a*, 142*b*, 142*c*, and 142*d* closest to the pushed point pushes down the protrusion 162*a*1 at the outer end of the rotational member 162*a* of the link mechanism 160 (the arrow B in the drawing) prior to the remaining pushing portions 142*b*, 142*c*, and 142*d*.

This causes the rotational member 162*a* to rotate about the rotation center shaft 162A, and the lifting member 164 of the link mechanism 160 is pushed up (the arrow C in the drawing) by the protrusion 162*a*2 at the inner end of the rotational member 162*a*, as shown in FIG. 11. At that time, the lifting member 164 is guided by the through-hole 172A in the retaining member 172, so that the lifting member 164 can move upward while keeping the erect posture to push the push switch 152. This allows the operating force from the operating portion 120A to be transmitted to the push switch 152 via the link mechanism 160 efficiently and directly.

As a result, the operating surface of the push switch 152 is pushed by the upper end face 164*a* of the lifting member 164 to reverse the top of the metal-dome-like movable contact member provided in the push switch 152, thereby switching the push switch 152 to the ON state. At that time, the reverse operation of the movable contact member causes click feeling in the operating surface of the push switch 152.

At that time, the operating portion 120A of the operating member 120 is physically directly connected with the operating surface of the push switch 152 via the pushing member 140 and the link mechanism 160 (see the dotted line in the drawing). This allows the click feeling generated in the operating surface of the push switch 152 to be transmitted to the operating portion 120A of the operating member 120 with little attenuation via the link mechanism 160 and the pushing member 140. As a result, the user can directly obtain the click feeling generated in the operating surface of the push switch 152.

The pushing portions 142*b*, 142*c*, and 142*d* other than the pushing portion 142*a*, which has pushed the rotational member 162*a* prior to the others, come into contact with the protrusions 162*b*1, 162*c*1, and 162*d*1 at the outer ends of the remaining rotational members 162*b*, 162*c*, and 162*d* with no gap with the downward movement (the arrow D in the drawing) under their own weights to give a more continuous rotational force to the remaining rotational members 162*b*, 162*c*, and 162*d*. Thus, when the lifting member 164 is first pushed by the rotational member 162*a* (the arrow C in the drawing), the remaining rotational members 162*b*, 162*c*, and 162*d* rotate, with the protrusions 162*b*2, 162*c*2, and 162*d*2 at the inner ends of the remaining rotational members 162*b*, 162*c*, and 162*d* kept in contact with the lifting member 164 with no gap (the arrow E in the drawing) following the upward movement of the lifting member 164. This causes all of the rotational members 162*a*, 162*b*, 162*c*, and 162*d* after the push-down operation to rotate by substantially the same amount of rotation from the initial state before the push-down operation, making the lower end faces 142*a*1, 142*b*1, 142*c*1, and 142*d*1 of the pushing portion, which are respectively in contact with the protrusions 162*a*1, 162*b*1, 162*c*1, and 162*d*1 at the outer ends with no gap, horizontal at substantially the same height. In other words, the pushing member 140 and the operating member 120 integrated therewith move from the initial horizontal state to the substantially horizontal state. Therefore, even if the user pushes a portion other than the center of the operating portion 120A, the operating member 120 can be pushed down substantially horizontally without inclination.

Also when the center of the operating portion 120A is pushed, the input apparatus 100 of the present embodiment can transmit the operating force of the push-down operation directly to the push switch 152 via the closest one of the four rotational members 162 when viewed microscopically and the lifting member 164 and can directly obtain click feeling from the push switch 152 on a similar operating principle, and allows the operating member 120 to be pushed in a substantially horizontal state.

Since the input apparatus 100 of the present embodiment is configured such that the push switch 152 is mounted on the lower surface of the circuit board 150, and the link mechanism 160 is also disposed under the circuit board 150, the upper surface of the circuit board 150 is provided with only the LED 154, as is seen from FIGS. 10 and 11. In other words, the input apparatus 100 of the present embodiment is configured such that the space between the circuit board 150 and the operating member 120 is free and can be used effectively. In other words, in the present embodiment, the space between the circuit board 150 and the operating member 120 has no interceptor and be used as a guide path for the light emitted from the LED 154. Alternatively, a light guide or a reflector can be freely disposed therein. The input apparatus 100 of the present embodiment includes the LED 154 to irradiate the back of the operating member 120. If there is no need for it, the LED 154 need not be mounted on the upper surface of the circuit board 150.

As described above, the input apparatus 100 of the present embodiment includes the operating member 120 to be pushed down, the circuit board 150 disposed under the operating member 120, the push switch 152 disposed on the lower surface of the circuit board 150, and the link mechanism 160 including the rotational member 162 that is rotatably disposed under the circuit board 150 and that pushes the push switch 152 upward by rotating in response to a push-down operation.

Thus, the input apparatus 100 of the present embodiment allows making effective use of the space between the circuit board 150 and the operating member 120 as a free space while enabling a direct push switch operation on the operating member 120.

In the input apparatus 100 of the present embodiment, the push switch 152 is a metal dome switch, and the link mechanism 160 includes the lifting member 164 provided under the push switch 152 so as to be vertically movable and the rotational member 162 that pushes the push switch 152 upward via the lifting member 164 by rotating in response to the push-down operation to push up the lifting member 164.

Thus, the input apparatus 100 of the present embodiment allows giving the click operation feeling generated by the push switch 152 directly at the operating member 120. Furthermore, the input apparatus 100 of the present embodiment allows pushing the operating surface of the push switch 152 upward straight with the lifting member 164. In other words, the input apparatus 100 of the present embodiment makes the operating surface of the push switch 152 less prone to being obliquely pushed, thereby reducing changes in the operation load of the push switch 152.

The input apparatus 100 of the present embodiment further includes the retaining member 172 that retains the circuit board 150 at a position facing the push switch 152. The retaining member 172 includes the through-hole 172A passing therethrough in the vertical direction. The lifting member 164 is vertically movable in the through-hole 172A.

Thus, the input apparatus 100 of the present embodiment allows pushing the operating surface of the push switch 152 upward more straight with the lifting member 164. In other words, the input apparatus 100 of the present embodiment makes the operating surface of the push switch 152 even less prone to being obliquely pushed, thereby more reducing changes in the operation load of the push switch 152.

The input apparatus 100 of the present embodiment allows restricting the amount of upward movement of the lifting member 164 with the retaining member 172, thereby preventing a damage to the push switch 152 due to excessive pushing of the push switch 152.

The input apparatus 100 of the present embodiment retains the portions of the circuit board 150 adjacent to the push switch 152 with the hooks 172B of the retaining member 172 to reduce changes in the position of the push switch 152 due to the bending of the circuit board 150, thereby reducing changes in the operation feeling of the push switch 152.

In the input apparatus 100 of the present embodiment, the link mechanism 160 may include the plurality of the rotational members 162 extending from below the lifting member 164 in horizontal directions different from one another (in the X-axis direction and the Y-axis direction).

Thus, even if a position of the operating member 120 other than the center is pushed, the input apparatus 100 of the present embodiment allows directly pressing the push switch 152 via the rotational member 162 according to the operating position of the operating member 120 and allows directly obtaining click feeling from the push switch 152.

The input apparatus 100 of the present embodiment further includes the LED 154 which is provided on the upper surface of the circuit board 150 and which emits light toward the back of the operating member 120. In other words, the input apparatus 100 of the present embodiment is configured such that the link mechanism 160 and so on are not present in the radiation direction of the light emitted from the LED 154. This allows the light emitted from the LED 154 to be efficiently radiated toward the back of the operating member 120.

Having described embodiments of the present invention, it is to be understood that the present invention is not limited to the embodiments and that various modifications and changes may be made within the spirit and scope of the present invention described in the claims.

For example, in the present embodiment, the operating member 120 and the pushing member 140 are separate objects combined. However, they may be integrally formed.

Although the present embodiment uses a metal dome switch as the push switch 152, another type of push switch, such as a rubber dome switch, may be used.

In the input apparatus 100 of the present embodiment, the LED 154 is installed in the free space between the circuit board 150 and the operating member 120. Alternatively, a mechanism for sensing the push-down operation force of the user, for example, may be provided.

What is claimed is:

1. An input apparatus comprising:

a base member;

an operating member provided so as to be vertically movable with respect to the base member, the operating member being configured to be pushed down;

a circuit board fixed to the base member and provided under the operating member;

a push switch provided on a lower surface of the circuit board;

a link mechanism including a rotational member disposed under the circuit board such that a rotation center shaft is rotatably held by the base member, the rotational member pushing the push switch upward by rotating in response to a push-down operation of the operating member; and a retaining member supported, under the push switch, by the base member, wherein the link mechanism includes:

a lifting member provided under the push switch so as to be vertically movable; and the rotational member is configured to push the push switch upward via the lifting member by rotating in response to the push-down operation of the operating member to push up the lifting member, wherein the retaining member includes a through-hole in a vertical direction, and wherein the lifting member is vertically movable in the through-hole.

2. The input apparatus according to claim 1, wherein the retaining member includes retaining arms that pass through the circuit board at positions adjacent to the push switch and engages with an upper surface of the circuit board to retain the circuit board.

3. The input apparatus according to claim 1, wherein the link mechanism includes a plurality of rotational members extending from below the lifting member in directions different from one another.

4. The input apparatus according to claim 3, further comprising a plurality of pushing portions provided under the operating member, the pushing portions pushing down a corresponding rotational member of the plurality of rotational members.

5. The input apparatus according to claim 1, wherein the push switch is a metal dome switch and generates a click feeling as the operating member is pushed down.

6. The input apparatus according to claim 1, further comprising a light-emitting means provided on an upper surface of the circuit board, the light-emitting means emitting light toward a back of the operating member.

* * * * *